US012571107B2

(12) United States Patent
Hong et al.

(10) Patent No.: US 12,571,107 B2
(45) Date of Patent: Mar. 10, 2026

(54) NANOCOMPOSITE COATING MATERIAL FOR ROLLERS OF SECONDARY BATTERY ELECTRODE MANUFACTURING EQUIPMENT AND MANUFACTURING SYSTEM THEREOF

(71) Applicant: INNOTION TECH Co., Ltd., Siheung-si (KR)

(72) Inventors: Jeong Ki Hong, Siheung-si (KR); In Ki Hong, Siheung-si (KR); Myoung Ki Hong, Ulsan (KR)

(73) Assignee: INNOTION TECH Co., Ltd., Siheung-si (KR)

( * ) Notice: Subject to any disclaimer, the term of this patent is extended or adjusted under 35 U.S.C. 154(b) by 0 days.

(21) Appl. No.: 18/884,966

(22) Filed: Sep. 13, 2024

(65) Prior Publication Data

US 2025/0171907 A1 May 29, 2025

(30) Foreign Application Priority Data

Nov. 28, 2023 (KR) ..... 10-2023-0167831

(51) Int. Cl.
*C23C 28/04* (2006.01)

(52) U.S. Cl.
CPC ..... *C23C 28/042* (2013.01)

(58) Field of Classification Search
CPC ..... C23C 14/00–14/5893; C23C 16/00–16/56; C23C 28/042; H01M 4/0409; H01M 4/0435
See application file for complete search history.

(56) References Cited

U.S. PATENT DOCUMENTS

2011/0135946 A1 6/2011 Konno et al.

FOREIGN PATENT DOCUMENTS

| | | | |
|---|---|---|---|
| CN | 110306153 | | 10/2019 |
| CN | 201910662656 | A | 10/2019 |
| JP | 1994023433 | | 1/1994 |
| JP | 06-280022 | A | 10/1994 |
| JP | 2001-032069 | A | 2/2001 |
| JP | 2009161813 | A | 7/2009 |
| JP | 2009288433 | A | 12/2009 |
| JP | 2010189694 | A | 9/2010 |
| JP | 201241629 | A | 3/2012 |
| JP | 201684516 | A | 5/2016 |
| JP | 2017136625 | A | 8/2017 |
| JP | 2021148292 | | 9/2021 |
| KR | 10-1709538 | B1 | 2/2017 |

(Continued)

OTHER PUBLICATIONS

Diamond-Like Carbon (DLC) Coatings: Classification, Properties, and Applications, Dipen Kumar Rajak et al., Applied science 2021, 11, 4445., Published: May 13, 2021.

(Continued)

*Primary Examiner* — Prashant J Khatri
(74) *Attorney, Agent, or Firm* — LADAS & PARRY LLP

(57) ABSTRACT

It is an object to provide a coating material having heat resistance, adhesion resistance, durability, chemical resistance, low friction, and releaseability applied to a base material, and to provide a manufacturing method and manufacturing system for such a coating material. A ternary nanocoposite coating material comprising C—F—H or C—F—Si applied to a base material is disclosed.

14 Claims, 4 Drawing Sheets

(56) References Cited

FOREIGN PATENT DOCUMENTS

| | | | | |
|---|---|---|---|---|
| KR | 10-1713423 | B1 | 3/2017 | |
| KR | 102188432 | B1 | 12/2020 | |
| KR | 102427732 | B1 | 8/2022 | |
| WO | 1999021927 | A1 | 5/1999 | |
| WO | WO-9936193 | A1 * | 7/1999 | ..... C23C 14/0641 |

OTHER PUBLICATIONS

Korean Intellectual Property Office (KIPO) Preliminary Examination Result Notification for copending Application No. 10-2023-0167831 dated Sep. 5, 2024.
Korean Intellectual Property Office (KIPO) Decision to Grant Patent or copending Application No. 10-2023-0167831 dated dated Sep. 5, 2024.
Extended European Search Report for copending Application No. 24197880.8 dated Aug. 21, 2025.

* cited by examiner

[FIG.1]
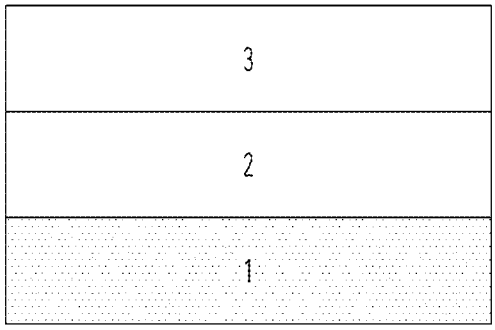
[FIG.2]
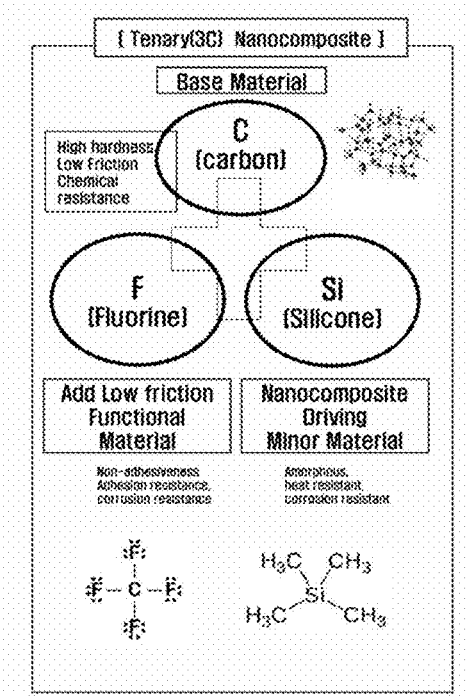

[FIG.3]

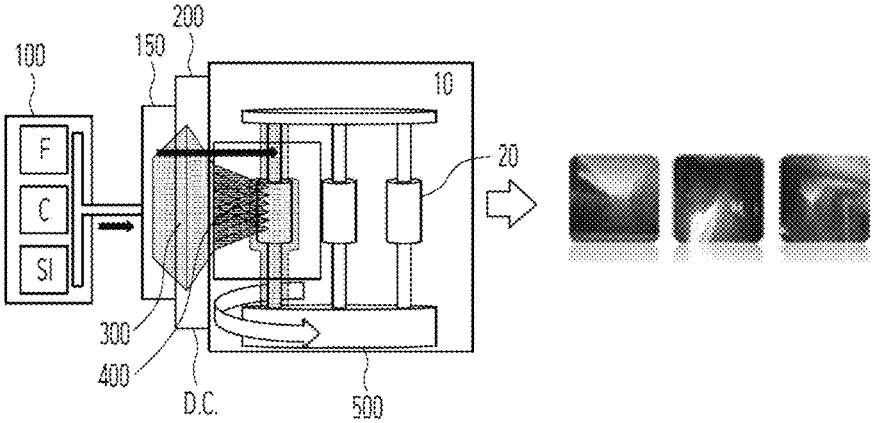

[FIG.4]

| Process | time (min.) | solid material | Pressure linear control by time | Source Power A linear control by time | Source Power V | Bias Power (V/A/khz) | note |
|---|---|---|---|---|---|---|---|
| ion CVD cleaning (HDP Linear cathode + CVD) | 30~300 | - | Ar (8~20mtorr) | 0.3~1.8 | 500~2000 | 50~500/0.3~1.5 (50~150khz) | Non-layer arcing control |
| Buffer layer High Discharge Plasma (HDP Sputter+ CVD) | 20~30 | Cr (4N high purity) | Ar (8~20mtorr) | 5~20 | 300~1000 | 80~500/0.5~2 (50~150khz) | Cr (Gradient1) |
| | 10~30 | Cr (4N high purity) | Ar/N/H (8~20mtorr H-reduction gas injection for CVD | 5~20 | 300~1000 | 80~500/0.5~2 (50~150khz) | CrN (Gradient2) |
| | 10~30 | Cr (4N high purity) | | 5~20 | 300~1000 | 80~500/0.5~2 (50~150khz) | CrN2 (Gradient3) |
| | 10~30 | Cr (4N high purity) | | 5~20 | 300~1000 | 80~500/0.5~2 (50~150khz) | CrN2 (Gradient4) |
| | 10~20 | Cr (4N high purity) | Ar/N/C/H (8~20mtorr) H-reduction gas injection for CVD | 5~20 | 300~1000 | 80~500/0.5~2 (50~150khz) | CrCH (Gradient5) |
| Top layer1 (HDP Linear cathode + CVD) | 240~780 | - | C2H2//H H-reduction gas injection for CVD | 0.3~1.8 | 500~2000 | 50~500/0.3~1.5 (50~150khz) | CH |
| Top layer2 (HDP Linear cathode + CVD) | 240~780 | - | C2H2/CF4/H H-reduction gas injection for CVD | 0.3~1.8 | 500~2000 | 50~500/0.3~1.5 (50~150khz) | CFH |
| Top layer3 (HDP Linear cathode + CVD) | 30~180 | - | CF4/H H-reduction gas injection for CVD | 0.3~1.8 | 500~2000 | 50~500/0.3~1.5 (50~150khz) | FCH arcing control |

[FIG.5]
| | AlN, CrN, TiN Coating | Nanocomposite carbon-based coating | Nanocomposite Ternary coating |
|---|---|---|---|
| Thickness | ~10um | 1~5um | 1~8um |
| Hardness | 15 ~ 25GPa | 17 ~ 25GPa | 15 ~ 23GPa |
| Friction Coefficient | 0.2 ~ 0.7 | 0.17~ 0.25 | ~0.12 or less |
| Adhesion Strength | HF1~2 / >20N | HF1~2 / >20N | HF1~2 / >20N |
| Contact Angle | 30° ~ 50° | 60° ~ 70° | 80° ~ 100° |
| Electrical Resistance Ω | Short (Arcing, static electricity) | $10^{A5}$Ω~$10^{-3}$Ω | $10^{A6}$~$10^{A5}$Ω (Antistatic level of resistance) |
[FIG.6]
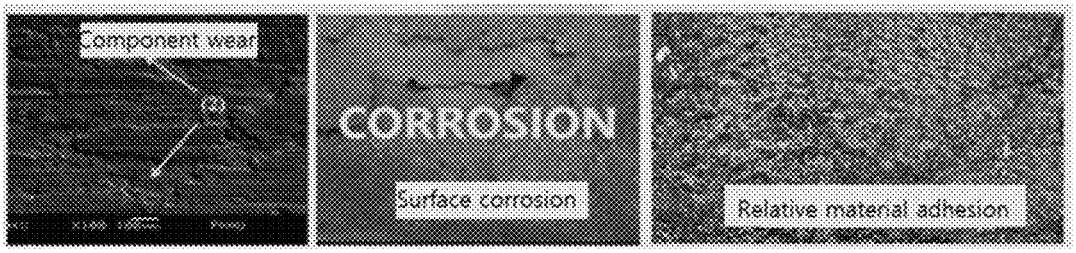

[FIG.7]
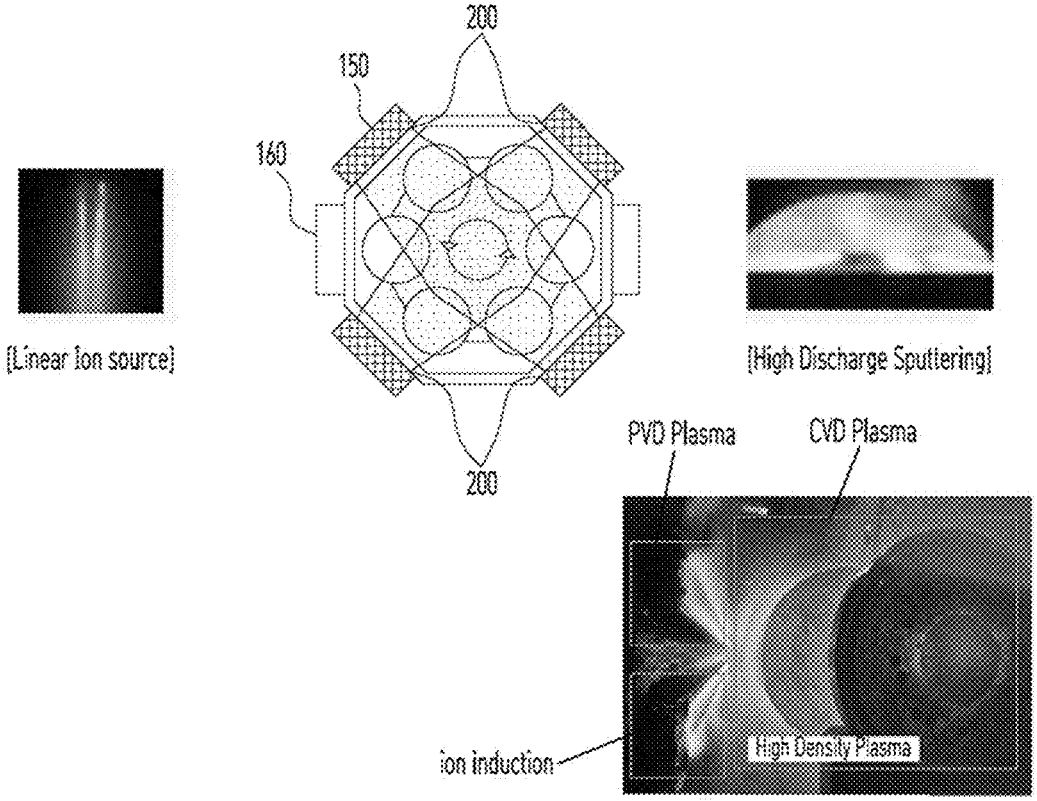
[FIG.8]
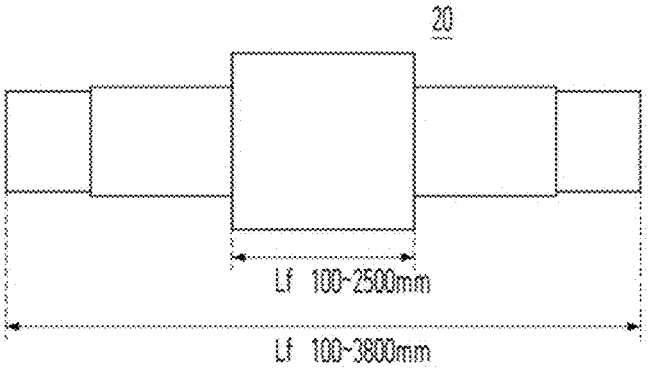

NANOCOMPOSITE COATING MATERIAL FOR ROLLERS OF SECONDARY BATTERY ELECTRODE MANUFACTURING EQUIPMENT AND MANUFACTURING SYSTEM THEREOF

CROSS-REFERENCE TO RELATED APPLICATIONS

This application claims the priority of Korean Patent Application No. 10-2023-0167831 filed on Nov. 28, 2023, in the Korean Intellectual Property Office, the disclosure of which is incorporated herein by reference.

FIELD OF THE INVENTION

The present invention relates to a nanocomposite coating material for rollers of a secondary battery electrode manufacturing facility and a manufacturing system thereof, and more particularly to a adhesion resistance (non-stick) nanocomposite coating material and a manufacturing system thereof.

BACKGROUND OF THE INVENTION

Rolling rollers, molds, mold ejection pins, combustion engine parts such as pistons, tappets, cylinder heads and shafts, motor parts, etc. require non-stick properties. In particular, the molds must be able to separate from the inner surface of the mold without sticking when the product is ejected after the hot melt solidifies. Combustion engine parts are also required to have a high-temperature non-stick surface because they rub at a considerable temperature, and motor parts also require high-temperature non-stick resistance due to the heat of friction. In addition, large rollers in secondary battery manufacturing facilities roll slurry-type materials, which require durability, chemical resistance, low friction, mold release, adhesion resistance, and heat resistance.

To achieve these properties, KR Patent No. 10-1709538 proposes a method of coating diamond-like carbon (DLC) on the surface of the rollers. However, DLC is weak to heat and difficult to apply to rollers for hot rolling, so there is a need to provide a better coating material that satisfies the above properties.

In addition, the rollers used in secondary battery electrode manufacturing facilities are large rollers weighing up to 5 tons, and unlike coatings on small members, it is a challenge to achieve a uniform coating on a large area.

SUMMARY OF THE INVENTION

It is an object of the present invention to provide a novel coating material having heat resistance, non-stick properties, durability, chemical resistance, low friction, and mold release, and to provide a manufacturing method and manufacturing system for such a coating material.

In accordance with the above objectives, the present invention provides a ternary nanocoposite coating material comprising C—F—Si or C—F—H.

Furthermore, the present invention provides a coating system in which a uniform coating over a large area can be achieved, and for this purpose, a nanocomposite coating system is provided in which a ternary nanocomposite coating material comprising C—F—Si or C—F—H is coated on a base material by a CVD process, comprising a large chamber into which a base material (a coating body) is loaded, an ion source applied to said chamber, and a raw material supply feeding C, F, Si or C, F, H to said ion source as raw material, respectively.

In the above, in order to uniformly coat a large surface area in a large chamber, a dense plasma must be formed, so permanent magnets or electromagnets are arranged in the ion source to form a magnetic field, so that the plasma is densely packed in a predetermined space.

In order to strongly attract the generated plasma and electrons towards the workpiece, a high bias voltage of 50 to 500 volts is applied to the workpiece, including a power supply, wherein the jig holding the base material is rotatably configured to rotate during the coating process.

In the above, a cylinder sputtering device including a Cr cylinder target is mounted in said chamber so that a Cr-based buffer layer is formed on the surface of the base material prior to coating the ternary nanocomposite.

The present invention further comprises a method for forming a ternary nanocomposite coating comprising C—F—Si or C—F—H using said coating system, the method comprises: supplying at least one of hydrocarbon gas, F gas, $SiH_4$, $Si_2H_6$, or $SiH_2Cl_2$ to a raw material supply of an ion source, further supplying hydrogen ($H_2$) to form a reducing atmosphere, applying a power of 500 to 2000 V, 0.3 to 1.8 A to the ion source, and applying a bias voltage of 50 to 500 V to a base material to form a ternary nanocomposite coating material comprising C—F—Si.

The present invention also provides a method for forming a ternary nanocomposite coating material comprising C—F—H by supplying hydrocarbon gas, F gas, to a raw material supply of an ion source, further supplying hydrogen ($H_2$) to form a reducing atmosphere, applying a power of 500 to 2000 V, 0.3 to 1.8 A to the ion source, and applying a bias voltage of 50 to 500 V to a jig on which a base material is fixed.

In the method, before forming the ternary nanocomposite coating material, the base material is plasma cleaned, and an inert gas (Ar or the like) is flowed to the raw material supply of an ion source, and a power of 500 to 2000 V, 0.3 to 1.8 A is applied to the ion source, and a bias voltage of 50 to 500 V is applied to the base material.

In the above, after plasma cleaning and before forming the ternary nanocomposite coating, a Cr-based buffer layer is formed using a sputtering device including a Cr cylinder target, and the process is carried out by applying 5 to 20 A, 300 to 1000 V to the sputtering device, applying a bias voltage of 80 to 500 V to the base material, and flowing inert gas and/or nitrogen ($N_2$).

In the above, the plasma cleaning is performed for 30 to 300 minutes, the buffer layer formation process is performed for 40 to 200 minutes, and the ternary nanocomposite coating formation process is performed for 240 to 780 minutes.

In the above, the ternary nanocomposite coating material has an increased content of F component towards the surface to enhance the releaseability and adhesion resistance.

In the above, the buffer layer is a gradient layer formed in the order of Cr/CrN/$CrN_2$/$CrN_2$ (N component enhancement)/CrCH.

The ternary nanocomposite coating material comprising C—F—Si according to the present invention exhibits high hardness characteristics of 17 to 27 GPa, excellent durability as the bonding force of the coating material is greater than 20 N, low friction coefficient of 0.12 or less, and contact angle of 90° or more, resulting in excellent adhesion resistance, mold release, and chemical resistance.

In other words, according to the present invention, a ternary nanocomposite coating can be formed on the surface of the base material, and a continuous process can be carried out without long-term maintenance, thereby improving the productivity of in-line manufacturing facilities.

In addition, the ternary nanocomposite coating material according to the present invention exhibits an electrical resistance of 105 to 108Ω, which prevents the occurrence of static electricity and arcing during work or at rest, and prevents the adhesion of foreign substances.

In addition, the ternary nanocomposite coating manufacturing system according to the present invention does not generate defects on the surface of the coating material due to arcing, which has been a problem with conventional ion sources, resulting in better surface finish and improved product quality.

BRIEF DESCRIPTION OF THE DRAWINGS

FIG. 1 is a layered cross-sectional view illustrating the composition of a ternary nanocomposite coating according to the present invention.

FIG. 2 is a schematic diagram illustrating the functionality of each component of the ternary nanocomposite coating according to the present invention.

FIG. 3 is a drawing and photograph showing the configuration of a ternary nanocomposite coating manufacturing system according to the present invention and the resulting high density plasma generation.

FIG. 4 is a table describing the process of manufacturing the ternary nanocomposite coating of the present invention.

FIG. 5 is a table comparing the properties of the ternary nanocomposite coatings of the present invention with the prior art.

FIG. 6 is a photograph illustrating a problem with the surface of a roller, which is a base material according to the prior art.

FIG. 7 is a photograph and a schematic diagram showing the configuration of a manufacturing system for manufacturing a buffer layer and a ternary nanocomposite coating according to the present invention.

FIG. 8 is an example of a roller to which the coating of the present invention is applied, showing the length of the functional surface Lf and the total length Lt of the roller.

DETAILED DESCRIPTION

Hereinafter, preferred embodiments of the present invention will be described in detail with reference to the accompanying drawings.

The nanocomposite coating of the present invention is capable of exhibiting adhesion resistance, heat resistance, chemical resistance, mold release, low friction, and durability, and can be applied to rolling rollers, molds, extraction pins, combustion engine parts (pistons, tappets, cylinder heads, shafts, etc.), motor parts, rollers for secondary battery manufacturing facilities, etc. The nanocomposite coatings of the present invention can be applied to a variety of articles wherever the properties described above are required. The following embodiment describes in detail a roller for a secondary battery manufacturing facility, but the same coating technology can be applied to other articles such as molds, and it is easy for those skilled in the art to replace the base material.

Rollers in secondary battery manufacturing facilities include cold rolling, hot rolling, and guide rollers. In a facility where rollers are used to continuously process electrode materials to produce electrodes, the durability, sticking resistance, heat resistance, chemical resistance, mold release, and low friction of the rollers directly affect the maintenance cycle and affect the performance of the final product, the electrode. Therefore, the above properties of the rollers ultimately lead to battery price competitiveness.

As illustrated in FIG. 6, the surface of a conventional roller is subject to corrosion and adhesion of the counterpart material, and the resulting product has traces of wear. As a coating material with more enhanced properties than conventional nitride-based coatings, the present invention proposes a ternary nanocomposite coating material comprising C—F—Si as shown in FIG. 1. FIG. 1 shows a cross-sectional view of a ternary nanocomposite coating formed by a buffer layer (2) on a base material (1) and a top layer (3) on the buffer layer.

In other words, as shown in FIG. 2, we designed a three-component nanocomposite coating based on C component, which can exhibit high hardness, low friction, and chemical resistance; F component, which can enhance release, adhesion resistance (non-stick), and corrosion resistance; and Si component, which can enhance amorphousness, heat resistance, and corrosion resistance.

Since the rollers prior to coating are originally composed of mostly chromium steel, it is advantageous to compose a Cr-based buffer layer to enhance the adhesion of the nanocomposite coating of the present invention. The buffer layer comprises at least one of Cr, Cr—N, and Cr—N—C. The composition of such a buffer layer can be applied to other articles (combustion engine parts, motor parts, press molds, die-casting molds, mold members such as extraction pins, etc.) as long as the base material includes chromium steel.

The buffer layer is preferably formed with a thickness of 20 to 200 nm, and the ternary nanocomposite coating material including C—F—Si is preferably formed with a thickness of 1 to 5 μm.

The formation of such nanocomposite coating materials for secondary battery manufacturing facility rollers requires a large-scale manufacturing system because the rollers themselves are large in size, and as manufacturing facilities including chambers become larger, it is necessary to form a uniform coating over a large area. Large-area uniform coating is required not only for rollers in secondary battery manufacturing facilities, but also for large molds and rolling rollers, and for small parts such as combustion engine parts and extraction pins, the need for large-area uniform coating is the same because they are inserted in large quantities.

FIG. 3 illustrates a manufacturing system for a ternary nanocomposite coating for a secondary battery manufacturing facility roller according to the present invention.

A roller 20 weighing about 5 tons includes a roller with a center functional surface Lf and a shaft extending from the center to both ends. The chamber 10 in which the roller with a total length of about 3 meters is loaded is also enlarged, and a further enlarged chamber is preferred because it is possible to form a coating layer on a plurality of products with a single coating, thereby reducing the manufacturing cost.

Both shaft ends of the roller are fixed to a rotatable jig 500, which is composed of a conductor and has an electrical connection for applying a strong bias voltage to the roller.

Because the rollers weigh as much as 5 tons, it is more stable to have the shaft ends supported on the floor and ceiling of the chamber than to have the shaft ends supported in the air, i.e., the jig is placed on the floor and ceiling of the chamber, and the rollers are vertically arranged and rotated by the turntable-type jig 500 during the process. The same fixing configuration of the base material also applies to the rollers, molds, and other small members, many of which are radially fixed to the large rotating jig, and the jig includes members such as shackles.

Equip a large chamber with an ion source 150, preferably a linear ion source, as a means for forming a C—F—Si ternary nanocomposite coating. A raw material supply part 100 is configured to supply a reaction gas to be supplied to the ion source, and a CVD process is performed in which the reaction gas is ionized and the electrons of the generated ions generate a plasma to form a coating layer on the surface of the roller. As will be described later, a sputter source is added in addition to the ion source 150 (see FIG. 7).

Due to the large chamber space and the dispersed generation of ternary cations, it is difficult to efficiently form a uniform coating layer over a large area unless the generated plasma is densified. Accordingly, the present invention comprises an ion induction device 200 having magnets arranged in an ion source to trap and densify the plasma in a predetermined space with electromagnetic force. The arrangement of magnets may be permanent magnets and/or electromagnets. Preferably, permanent magnets are arranged to generate a constant magnetic force and prevent heat generation. However, it can also consist of electromagnets, and electromagnets can be arranged superimposed with permanent magnets to complement the magnetic field produced by the permanent magnets.

In other words, in a coating system with an array of permanent magnets, the magnetic field can be supplemented by driving electromagnets in locations where the magnetic force can be varied to analyze the density of the plasma or to control the plasma distribution by viewing the results of coating a sample. The generated ions and plasma form a low-density plasma region 300 at the beginning of the generation, and a high-density plasma region 400 is formed by the ion inducer 200.

In addition, it is necessary to strongly attract the densified plasma to the base material roller, so a bias voltage is applied to the base material roller, and a very large power bias is applied. In this embodiment, the bias voltage applied to the roller is 50 to 500 V, as shown in FIG. 4, and a bias current of 0.3 to 1.5 A is applied. For small workpieces other than the rollers, the bias voltage is applied to the jig. If the workpiece is a mold, the bias voltage is applied to the mold either through the mold itself or through a mold holding member.

In the upper right corner of FIG. 3 is a photograph showing the behavior of a dense plasma generated by a magnetic field and a strong bias voltage. Even in a large space within a large chamber, the plasma is not dispersed but concentrated in the space where the coating layer is to be formed, forming a coating layer with high energy due to strong attraction.

On the other hand, as described above, to form a buffer layer for strong adhesion of the ternary nanocomposite coating to the base material, a buffer layer forming system is added accordingly. That is, a sputter source (sputtering device) 160 is added in addition to the ion source 150 in the chamber as shown in FIG. 7. To form a Cr-based buffer layer, a cylinder sputter source with a Cr cylinder target is mounted in the chamber.

The ion source and sputter source are arranged in pairs at each end of the chamber centered on the workpiece (roller). This arrangement of the coating sources is advantageous for forming a uniform coating layer on the rollers rotating in the center.

The manufacturing process of the ternary nanocomposite coating using the coating system is as follows (FIG. 4).

First, the surface of the base material is plasma cleaned. After vacuuming the inside of the chamber to $10^{-6}$ to $10^{-5}$ torr, preferably to a process starting pressure of $7.0\times10^{-5}$ torr or less, an inert gas such as Ar is supplied to the chamber at a working pressure of 8 to 20 mtorr, and the ion source is driven to clean for 30 to 300 minutes. The voltage applied to the ion source is 500 to 2000 V and the current is 0.3 to 1.8 A, and the bias voltage applied to the roller is 50 to 150 kHz, 50 to 500 V, and the bias current is 0.3 to 1.5 A. The roller is cleaned by driving the ion source for 30 to 300 minutes.

After plasma cleaning, drive the sputter source in conjunction with the ion source to form a Cr-based buffer layer. Apply a bias voltage to the Cr cylinder target, flow inert gas such as Ar and/or nitrogen ($N_2$) gas, and apply 300 to 1000 V, 5 to 20 A to the sputter source to form a buffer layer for 40 to 200 minutes. The process temperature is room temperature. The composition of the buffer layer may be one or more of Cr, Cr—N, Cr—N—C.

During the first 20 to 30 minutes of buffer layer formation, an inert gas such as Ar is supplied to the chamber at an operating pressure of 8 to 20 mtorr, and a bias current of 50 to 150 kHz, 80 to 500 V bias voltage, and 0.5 to 2 A is applied to the roller to form a Cr layer (first gradient layer). Then, while keeping the sputter source power and roller bias power unchanged, Ar, $N_2$, and reducing $H_2$ gas are supplied to the chamber at an operating pressure of 8 to 20 mtorr to form CrN (second gradient layer), $CrN_2$ (third gradient layer), and $CrN_2$ (fourth gradient layer) by increasing the proportion of nitrogen supply in three sections of 10 to 30 minutes to form the nitrided hardened layer. For the next 10 to 20 minutes, Ar, $N_2$, carbon (C), and $H_2$ are supplied while keeping the sputter source power and roller bias power unchanged to form the CrCH carbon nitride hardened layer as the fifth gradient layer. The carbon source can be hydrocarbon gas. The buffer layer formed in this way is 0.3 to 1.0 μm thick, which strengthens the bonding force and enhances the impact resistance.

Supplying at least one of hydrocarbon gas, $CF_4$ gas, tetramethylsilane (TMS), $SiH_4$, $Si_2H_6$, or $SiH_2Cl_2$ to the raw material supply of the ion source, further supplying hydrogen ($H_2$) to form a reducing atmosphere, applying a bias voltage of 500 to 2000 V, 0.3 to 1.8 A, and applying a bias voltage, current of 50 to 150 kHz, 50 to 500 V, and 0.3 to 1.5 A to the base material to form a ternary nanocomposite coating comprising C—F—Si. Hydrogen is supplied by hydrocarbon gas, but in the present invention, hydrogen ($H_2$) is supplied separately to enhance a more reductive atmosphere.

In the formation of a ternary nanocomposite coating, which is a top coating layer, hydrocarbons, reducing hydrogen, and TMS are supplied for the first 240 to 780 minutes to form a dense, high hardness, wear-resistant nanomatrix coating layer based on CH as a first top coating layer, and hydrocarbons, $CF_4$, reducing hydrogen, and TMS are supplied for the next 240 to 780 minutes to form a second top coating layer as an interfacial continuous layer to form a nanocomposite carbon containing CFH and an anti-adhesion functional layer.

Then, for 30 to 180 minutes, hydrocarbons, $CF_4$, reducing hydrogen, and TMS are supplied, but the supply ratio of $CF_4$ is further increased to form the FCH coating layer as a third top coating layer to strengthen the adhesion resistance of the roller surface. In other words, the top coating layer increases the F component toward the surface to strengthen the adhesion resistance of the base material (roller, etc.) surface. When forming the third top coating layer, the arcing of the driving part should be controlled so as not to harm the demolding. The total thickness of the top coating layer should be 1 to 3 μm thick. The process temperature should be room temperature.

On the other hand, in forming the top coating layer, it is also possible to exclude Si and compose C—F—H as a ternary nanocomposite coating material, i.e., a C—F—H composite coating material as required, which can also exhibit the required release and high hardness. The inclusion of Si is more favorable for improving low friction, so the composition of the coating can be selected according to the desired property specification.

Control the amount of reactant supply so that the composition ratio of F and Si in the C—F—H ternary nanocomposite coating layer or the C—F—Si ternary nanocomposite coating layer is 0 to 20 at %. Preferably, the composition ratio of F is 0.1 to 20 at %.

Since the process temperature is at room temperature, there are few restrictions on the type of base material.

By carrying out the process in this manner, a ternary nanocomposite coating layer with a total thickness of 1 to 5 μm including the buffer layer is formed.

The physical properties of the ternary nanocomposite coating layer formed in this manner are shown in FIG. 5.

The ternary nanocomposite coating comprising C—F—Si according to the present invention exhibits high hardness properties of 17 to 27 GPa, excellent durability as the bonding force of the coating is greater than 20 N, low friction coefficient of 0.12 or less, and contact angle of 90° or more, resulting in excellent adhesion resistance, mold release, and chemical resistance. These are much better properties than conventional nitride-based coatings.

In addition, the ternary nanocomposite coating of the present invention has an electrical resistivity of $1\times10^5$ to $9.9\times10^8\Omega$, which is sufficient to prevent electrification of equipment and prevent foreign matter from adhering. The base material of the roller coated with the nanocomposite coating of the present invention has the same electrical resistance value during operation as well as at rest, which prevents static electricity generation, arcing, and foreign body adhesion.

In other words, according to the present invention, a ternary nanocomposite coating can be formed on the surface of a base material such as a roller, enabling a continuous process without maintenance for a long period of time, thereby improving the productivity of the in-line system in the case of secondary battery manufacturing facilities.

Unless otherwise defined in the foregoing, all technical and scientific terms used herein shall have the same meaning as commonly understood by those skilled in the art to which the present invention belongs. Furthermore, commonly used dictionary-defined terms are not to be construed as anomalous or excessive unless expressly specifically defined. Throughout the specification, when a part is said to "include" a component, it is meant to be inclusive of other components, not exclusive of other components, unless specifically stated to the contrary. Also, the singular may include the plural as the context requires.

In addition, as used herein, references to "on top of, over, or above", "under", or "below" a subject part are intended to mean above or below the subject part and do not necessarily mean above or below with respect to the direction of gravity.

The rights of the invention are defined by the claims without limitation to the embodiments described above, and it is self-evident that one having ordinary skill in the field of the invention will be able to make various modifications and constructions within the scope of the claims.

The information on national R&D projects that supported this invention is as follows.

[Unique number for project] 020142225

[Project number] 20142225

[Ministry name] Ministry of SMEs and Startups

[Name of the project management (professional) organization] Korea Foundation for Establishment Promotion, Korea University Sejong Industrial-Academic Cooperation Group

[Name of the research business project] 2023 Innovation Start-up Package (Fostering New Industrial Start-ups)

[Name of Research Project] Manufacturing of Secondary Battery by Plasma Deposition System and Coating Process Technology of Large Area Nanocomposite Material Competitive Enhancement Technology Advanced Services

[Name of the project execution institution] Innotion Tech Co., Ltd

[Research period] 2023.04.27~2023.12.01

What is claimed is:

1. A coating material applied to a roller in secondary battery electrode manufacturing equipment, comprising:

a buffer layer sequentially including a Cr layer, a CrN layer, a $CrN_2$ layer, and a CrCH layer; and a ternary nanocomposite coating layer of C—F—H formed on the buffer layer, wherein the ternary nanocomposite coating layer is formed by supplying reducing hydrogen in addition to C and F components during the formation process, wherein the coating layer is a gradient coating layer comprising a higher concentration of the F component toward the surface, wherein the coating material has a contact angle of 90° or more, and has a high hardness characteristic of 17 to 27 GPa.

2. The coating material applied to a roller in secondary battery electrode manufacturing equipment according to claim 1, wherein the coating material exhibiting the adhesion resistance has a low friction coefficient of 0.12 or less and a bonding force of the coating material of 20 N or more.

3. The coating material applied to a roller in secondary battery electrode according to claim 1, wherein the coating material exhibiting the adhesion resistance has an electrical resistance of $1\times10^6$ to $9.9\times10^8\Omega$.

4. A coating material applied to a roller in secondary battery electrode manufacturing equipment, comprising:

a buffer layer sequentially including a Cr layer, a CrN layer, a $CrN_2$ layer, and a CrCH layer; and a ternary nanocomposite coating layer of C—F—Si formed on the buffer layer, wherein the ternary nanocomposite coating layer is formed by supplying reducing hydrogen in addition to C, F, and Si components during the formation process, wherein the coating layer is a gradient coating layer comprising a higher concentration of the F component toward the surface, wherein the coating material has a contact angle of 90° or more, and has a high hardness characteristic of 17 to 27 GPa.

5. The coating material applied to a roller in secondary battery electrode manufacturing equipment according to claim 4, wherein the coating material exhibiting the adhesion resistance has a low friction coefficient of 0.12 or less and a bonding force of the coating material of 20 N or more.

6. The coating material applied to a roller in secondary battery electrode according to claim 4, wherein the coating material exhibiting the adhesion resistance has an electrical resistance of $1\times10^6$ to $9.9\times10^8\Omega$.

7. A manufacturing system for a ternary nanocomposite coating material comprising C—F—H, or C—F—Si, applied to a roller used in secondary battery electrode manufacturing equipment, comprising:

a large chamber into which a roller is loaded;

an ion source applied to said chamber;

a cylinder sputter source including a Cr target to form a Cr-based buffer layer prior to coating the ternary nanocomposite coating on the surface of the roller;

a raw material supply unit for feeding said ion source with C, F, and H, or C, F, and Si, respectively, as raw materials; and a power supply unit;

wherein the power supply unit applies a bias voltage of 50 to 500 volts to the roller to attract the generated plasma and electrons toward the roller, wherein the ion source includes permanent magnets or electromagnets arranged to generate high-density plasma, wherein the cylindrical sputtering source is utilized to form a buffer layer on the roller used in secondary battery electrode manufacturing equipment, comprising, in order, a Cr layer, a CrN layer, a $CrN_2$ layer, and a CrCH layer, wherein a ternary nanocomposite coating layer of C—F—H is formed on the buffer layer by supplying hydrocarbon gas, $CF_4$, and reducing hydrogen ($H_2$) to the ion source as raw materials, or a ternary nanocomposite coating layer of C—F—Si is formed on the buffer layer by supplying hydrocarbon gas, $CF_4$, reducing hydrogen ($H_2$), and at least one of TMS (Tetramethylsilane), $SiH_4$, $Si_2H_6$, or $SiH_2Cl_2$ as Si sources to the ion source, and the nanocomposite coating layer is formed as a gradient coating layer comprising more of the F component toward the surface.

8. The nanocomposite coating material manufacturing system according to claim 7, wherein, in order to uniformly coat a large-area surface of the roller inside a large chamber, permanent magnets or electromagnets are arranged in the ion source to generate a magnetic field, thereby concentrating plasma in a predetermined space and forming high-density plasma.

9. The nanocomposite coating manufacturing system according to claim 8, wherein the permanent magnet and the electromagnet are arranged together to form a magnetic field by the permanent magnet, and selectively drive the electromagnet at a predetermined position to complement the magnetic field formed by the permanent magnet with the electromagnet.

10. The nanocomposite coating material manufacturing system according to claim 7, further comprising a jig for holding both ends of the roller shaft, wherein the jig is rotatably configured such that the roller is rotated during the coating process.

11. A method of forming a ternary nanocomposite coating material comprising C—F—H using the nanocomposite coating material manufacturing system according to claim 7, comprising:

prior to forming the ternary nanocomposite coating material, applying a voltage of 300 to 1000 V to a sputter source including a Cr cylinder target, applying a bias voltage of 80 to 500 V to the roller, flowing at least one of an inert gas and nitrogen ($N_2$) to perform a sputtering process to form a Cr-based buffer layer, wherein, in the buffer layer forming process:

initially, only the inert gas is supplied to form a Cr layer, subsequently, the inert gas, nitrogen, and reducing hydrogen are supplied to form a CrN layer, the nitrogen supply ratio is increased to enhance the nitrogen content and form a N-enhanced nitride hardening layer, in the final stage of buffer layer formation, the inert gas, nitrogen, reducing hydrogen, and hydrocarbon gas are supplied to form a carbonitrided hardening layer of CrCH as a gradient layer, supplying hydrocarbon gas, $CF_4$ gas, and reducing hydrogen ($H_2$) to the raw material supply unit of the ion source, applying a voltage of 500 to 2000 V to the ion source and a bias voltage of 50 to 500 V to the roller to form a ternary nanocomposite coating material containing C—F—H, wherein the composition ratio of $CF_4$ gas supplied to the raw material supply unit of the ion source is gradually increased to form a gradient layer in which the fluorine (F) content increases toward the surface of the ternary nanocomposite coating material, wherein, in the formation of the ternary nanocomposite coating material, initially, hydrocarbon and reducing hydrogen are supplied to form a first top coating layer comprising a CH-based high-density, high-hardness, and wear-resistant nanomatrix coating, subsequently, hydrocarbon, $CF_4$ gas, and reducing hydrogen are supplied to form a second top coating layer as an interfacial transition layer comprising CFH-based nanocomposite carbon with anti-sticking functionality, then, hydrocarbon, $CF_4$, and reducing hydrogen are supplied with an increased $CF_4$ supply ratio to form a FCH coating layer as a third top coating layer, thereby enhancing the anti-sticking property of the roller surface.

12. The method of forming the ternary nanocomposite coating according to claim 11, wherein prior to forming the buffer layer, plasma cleaning is performed on the roller, wherein the voltage applied to the ion source is 500 to 2000 V, the current is 0.3 to 1.8 A, and the bias voltage applied to the roller is 50 to 150 khz, 50 to 500 V.

13. A method for forming a ternary nanocomposite coating material comprising C—F—Si using the nanocomposite coating material manufacturing system according to claim 7, comprising:

prior to forming the ternary nanocomposite coating material, applying a voltage of 300 to 1000 V to a sputter source including a Cr cylinder target, applying a bias voltage of 80 to 500 V to the roller, flowing at least one of an inert gas and nitrogen ($N_2$) to perform a sputtering process to form a Cr-based buffer layer, wherein, in the buffer layer forming process:

initially, only the inert gas is supplied to form a Cr layer, subsequently, the inert gas, nitrogen, and reducing hydrogen are supplied to form a CrN layer, the nitrogen supply ratio is increased to enhance the nitrogen content and form a N-enhanced nitride hardening layer, in the final stage of buffer layer formation, the inert gas, nitrogen, reducing hydrogen, and hydrocarbon gas are supplied to form a carbonitrided hardening layer of CrCH as a gradient layer, supplying hydrocarbon gas, $CF_4$ gas, and at least one of TMS (tetramethylsilane), $SiH_4$, $Si_2H_6$, or $SiH_2Cl$ to the raw material supply unit of the ion source, and additionally supplying reducing hydrogen ($H_2$), applying a voltage of 500 to 2000 V to the ion source and applying a bias voltage of 50 to 500 V to the roller to form the ternary nanocomposite coating material comprising C—F—Si, wherein the composition ratio of $CF_4$ gas supplied to the raw material supply unit of the ion source is gradually increased to form a gradient layer in which the fluorine (F) content increases toward the surface of the ternary nanocomposite coating material, wherein, in the formation of the ternary nanocomposite coating material, initially, hydrocarbon, at least one of TMS, $SiH_4$, $Si_2H_6$, or $SiH_2Cl_2$, and reducing hydrogen are supplied to form a first top coating layer comprising a high-density, high-hardness, and wear-resistant nanomatrix coating, subsequently, hydrocarbon, $CF_4$ gas, at least one of TMS, $SiH_4$, $Si_2H_6$, or $SiH_2Cl_2$, and reducing hydrogen are supplied to form a second top coating layer as an interfacial transition layer comprising nanocomposite carbon with anti-sticking functionality, then, hydrocarbon, $CF_4$ gas, at least one of TMS, $SiH_4$, $Si_2H_6$, or $SiH_2Cl_2$, and reducing hydrogen are supplied with an increased $CF_4$ supply ratio to form a third top coating layer, thereby enhancing the anti-sticking property of the roller surface.

14. The method of forming the ternary nanocomposite coating according to claim 13, wherein prior to forming the buffer layer, plasma cleaning is performed on the roller, wherein the voltage applied to the ion source is 500 to 2000 V, the current is 0.3 to 1.8 A, and the bias voltage applied to the roller is 50 to 150 khz, 50 to 500 V.

* * * * *